US006539660B1

(12) United States Patent
Yeargin

(10) Patent No.: US 6,539,660 B1
(45) **Date of Patent: *Apr. 1, 2003**

(54) HANDGUN REST FOR FIELD AND HUNTING USE

(76) Inventor: William D. Yeargin, 107 Susan La., Circleville, NY (US) 10919

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/444,433

(22) Filed: Nov. 22, 1999

(51) Int. Cl.[7] ..... F41C 29/00

(52) U.S. Cl. ..... 42/94; 89/37.04

(58) Field of Search ..... 42/94; 89/40.06, 89/37.04; 248/163.1, 122.1, 176.1

(56) References Cited

U.S. PATENT DOCUMENTS

| | | | | |
|---|---|---|---|---|
| 271,251 | A | * | 1/1883 | Leerbech et al. |
| 1,441,285 | A | * | 1/1923 | Johnston et al. |
| 1,524,973 | A | * | 2/1925 | Hazelton |
| 1,618,966 | A | * | 2/1927 | Bull |
| 2,168,988 | A | * | 8/1939 | Hultquist |
| 2,877,689 | A | * | 3/1959 | Pribis |
| 3,327,422 | A | * | 6/1967 | Harris |
| 3,445,082 | A | * | 5/1969 | Proctor et al. |
| 4,351,224 | A | * | 9/1982 | Curtis |
| 4,438,581 | A | | 3/1984 | LaValle |
| D276,668 | S | | 12/1984 | Minneman |
| 4,607,561 | A | * | 8/1986 | Frimer |
| 4,625,620 | A | | 12/1986 | Harris |
| 4,972,619 | A | * | 11/1990 | Eckert |

(List continued on next page.)

OTHER PUBLICATIONS

B–Square Catalog, exhibit K.*
B–Square Internet Catalog: http://www.reliablehost.com/bsquare/bipods.html.*
OH Products Internet Catalog: http://www.bullshootersighting.com/pistol.htm.*
Gunstands Internet Catalog: http://www.gunstands.com/bench.htm.*
Shooting Rests Internet Catalog: http://www.shootingrests.com/Shooting_Rest/Pistol_Rest/pistol_rest.html.*
TJ General Store Internet Catalog: http://tjgeneralstore.com/outers.htm.*

*Primary Examiner*—Michael J. Carone
*Assistant Examiner*—Troy Chambers
(74) *Attorney, Agent, or Firm*—Edward D. Manzo

(57) ABSTRACT

A handgun rest suitable for field use includes a shooting platform on which the shooter rests the butt of the handgun grip and both hands. The platform connects to an adjustable extension member or assembly projecting forward from the platform, angling upwards to provide both the required amount of upward rise and forward extension to come under, and provide the rest for, the forearm or barrel of the handgun. Thus the weight of the handgun is supported fore and aft, including the shooter's wrists and arms. The forward extension is folded when not in use, creating a compact and easily transported package. A leg assembly coupled beneath the platform permits both swiveling and canting. The leg assembly includes a pair of movable legs coupled about an axle which engages a bracket movably mounted under the platform. The bracket engages a pivot about which the bracket may rotate, within constraints, relative to the platform. The bracket mounting of the preferred embodiment allows the platform to rotate for target acquisition. Because the legs engage the axle within the bracket, the assembly is able to cant from side to side, allowing for adjustment to uneven ground. Preferably each leg telescopes or is otherwise able to be adjusted in length. The legs may be configured and connected so that when not in use, both legs fold under and parallel with the platform.

40 Claims, 9 Drawing Sheets

U.S. PATENT DOCUMENTS 5,029,407 A 7/1991 Kirkpatrick
5,074,188 A * 12/1991 Harris
5,194,678 A * 3/1993 Kramer
5,375,337 A * 12/1994 Butler
5,377,437 A 1/1995 Underwood
5,406,732 A 4/1995 Peterson
5,419,233 A * 5/1995 Mulvaney
5,600,913 A 2/1997 Minneman
5,617,666 A * 4/1997 Scott
5,628,135 A 5/1997 Cady
5,661,919 A * 9/1997 Pryor
5,666,757 A 9/1997 Helmstadter
D387,123 S * 12/1997 Hughes et al.
5,711,103 A * 1/1998 Keng
5,715,624 A 2/1998 Hilbelink et al.
5,740,625 A 4/1998 Jenkins
5,794,899 A 8/1998 Tamllos
5,815,974 A * 10/1998 Keng
5,930,932 A 8/1999 Peterson
6,044,747 A * 4/2000 Felts
6,058,641 A * 5/2000 Vecqueray

HANDGUN REST FOR FIELD AND HUNTING USE

FIELD AND BACKGROUND OF THE INVENTION

The present invention relates to shooting rests for firearms, especially handguns.

Since the development of firearms, numerous shooting rests have been devised to aid accuracy, and to be useful, any shooting rest must provide support for the firearm itself and serve to steady the shooter also. As firearms have become more efficient, aided with high magnification optical sights, precision shooting at long range has become the norm. This mandates that a shooting rest be used to achieve a measure of acceptable accuracy. This requirement becomes most evident when a handgun is used for long range shooting.

Generally, shooting rests comprise monopods, bipods, and tripods, rests designed for bench shooting; and rests which attach to the forearm of the gull. The majority of shooting rests, however, whether designed for field or bench use, are intended for rifles. For field or hunting applications, these shooting rests generally take the form of a bipod attaching directly to the rifle itself, or are designed to be carried as a separate component in the form of a mono-pod, bipod, or tripod device of different variations. Whether designed to be used in the prone, sitting, kneeling, or standing positions, these shooting rests are generally effective because a rifle while rested at the forearm (under the barrel) is also supported by the shooter's body, anchored at the shoulder, resulting in both the rifle and shooter being supported fore and aft. Because a rifle has a shoulder stock, this kind of shooting rest works well with any long-arm.

Handguns have a different shape and thus present a different problem. For using handguns in the field or when hunting, prior art shooting rests are not effective for accurate, long-range shooting. Unlike rifles, handguns are fired at arm's length, without the benefit of a shoulder stock. A shooting rest that rests only under the forearm or barrel leaves unsupported the handgrip, and more importantly the shooter's wrists and arms. Conversely, if a shooting rest supports the butt of the handgrip, the front of the handgun is left unsupported. Skilled shooters acknowledge that except for shooting at close range with iron or open sights, long range accuracy can be achieved only when the handgun is supported both fore and aft, and only when solid support is provided for the weight of the shooter's wrists and arms.

Handguns for long range, precision shooting generally are fitted or equipped with optical (telescopic) sights, and are represented by single shot and bolt action pistols or large frame revolvers. The combined handgun with sight is heavy and long, precluding offhand shooting. These handguns can be used at target shooting ranges, where a substantial bench rest can be configured to support the fore and aft portions of the weapon. However, bench rests are unsuitable for or inapplicable to field and hunting applications.

Monopod gun supports, represented by U.S. Pat. Nos. 5,740,625 or 276,668, offer no support for both fore and aft portions of a handgun. They are the least steady type of rest, even for rifle use, and almost must be pushed into the ground to be steady. They offer no adjustment provisions beyond height. They are, however, portable and simple.

Bipod gun supports, represented by U.S. Pat. No. 5,930,932 and U.S. Pat. No. 5,377,437, are still portable and steadier than monopod gun supports, but they still are inadequate for steady handgun shooting, notwithstanding their assertions to the contrary, due to their lack of the prescribed support. They are good for rifles, but not handguns.

Tripod gun supports such as U.S. Pat. No. 5,794,899 are big, bulky, and not highly portable. They are designed for camera use and are too complex for field use.

Bench rests are exemplified by U.S. Pat. Nos. 5,628,135, 4,438,581, and 5,600,913. They offer handguns support at both fore and aft. They are not designed for field use, due to their weight and bulk, or their rudimentary design. Such rests are clearly for bench use.

Another rest is represented by U.S. Pat. No. 5,666,757. It is not clear whether this is a bench rest, a monopod, or intended for hunting. Contrary to its assertions, it is not lightweight. Moreover, it is impractical to anchor the rest into the ground. Also, the center of gravity is incorrect, and the device is not portable.

Yet another gunrest style is represented by U.S. Pat. Nos. 5,029,407 and 4,625,620. The Kirkpatrick design folds into the fore end of the gun(rest). This style is advantageous for supporting a rifle, but it fails to support both the fore and aft portions of a handgun simultaneously. This design requires attachment to the firearm itself, thus making a handgun very cumbersome. Also, this design does not adapt to all handguns. It requires support under the shooter's hands when used in a prone shooting position, and it does not suffice from the sitting position, which is the more useful position in the field.

Hilbelink U.S. Pat. No. 5,715,624 is for a handgun rest and offers a structure beneath fore and aft portions of the pistol. However, the shelf thereof (referred to by numeral 27) is not directly supported. Rather, the support is fashioned beneath the forearm or barrel, leaving the hands and arms of the shooter inadequately supported and apparently unstable. The point of support is offset from the weight of the shooter's hands and the majority of the weight of the gun. Moreover, the gunrest shown and described there would appear to need to be pushed into the ground, which is a disadvantage.

Each of the prior art designs, whether an attached bipod or separate device, is compromised in one or more ways. Therefore, the present invention seeks to provide a handgun shooting rest that meets all or several of these several criteria: it is suitable for field use, it offers fore and aft support for both hands and the pistol forearm or barrel, it allows the majority of the weight of the handgun and the weight of the shooter's hands and wrists to be disposed directly above the support; it is compact and easily carried; it is adaptable to both prone and sitting positions due to varying terrain conditions; it is capable of rapid deployment; and it offers a mechanism accommodating at least one but preferably both of swivel and canting movement, i.e. rotation in two orthogonal dimensions, for target acquisition and adjustment to uneven ground.

SUMMARY OF THE INVENTION

A handgun rest suitable for field use includes a shooting platform on which the shooter rests the butt of the handgun grip and both hands. An extension member or assembly projects forward from the platform, preferably angling upwards to provide both the required amount of upward rise and forward extension to come under, and provide the rest for, a forward portion of the gun, e.g. its forearm or barrel. A leg assembly is coupled beneath the platform. Thus the weight of the handgun is supported fore and aft.

Preferably the leg assembly permits two or more degrees of movement of the platform.

BRIEF DESCRIPTION OF THE DRAWINGS

A greater appreciation of the present invention will be gained from consideration of the following detailed description of a preferred embodiment thereof, in which reference is made to the accompanying drawings wherein.

DESCRIPTION OF THE PREFERRED EMBODIMENT

Introduction

Figure 1:
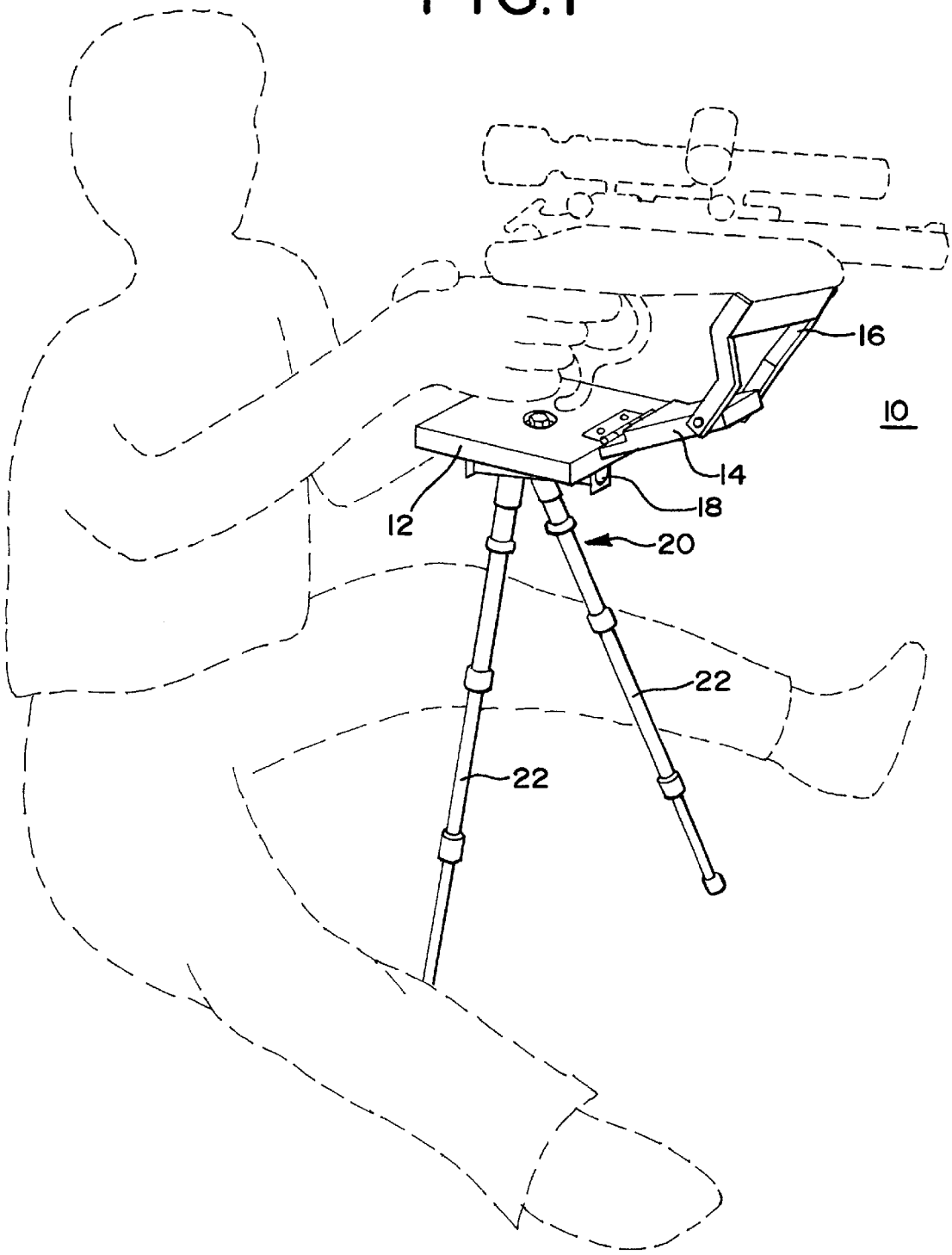
FIG. 1 is a perspective view showing in phantom a shooter in a sitting position utilizing a handgun rest according to the preferred embodiment.

By way of prefatory remarks, the preferred embodiment handgun rest suitable for use afield includes a shooting platform on which the shooter rests the butt of the handgun grip and both hands, thus providing the support for both the handgun and the shooter's wrists and arms. The platform connects to a preferably adjustable extension member or assembly projecting forward from the platform, preferably angling upwards to provide both the required amount of upward rise and forward extension to come under, and provide the rest for, the forearm or barrel of the handgun (which in the claims is referred to as a forward portion of the handgun). Thus the weight of the handgun is supported fore and aft, including the shooter's wrists and arms. A leg assembly is coupled beneath the platform and permits at least one but preferably two degrees of movement, both swiveling and canting.

In its preferred form, the forward extension is folded when not in use, creating a compact and easily transported package, although a foldable or collapsible forward extension is not required and the present invention can be practiced without this feature. The illustrated embodiment is a two-part articulated extension. Hinged to the platform is an inner extension, which due to the arrangement of the hinge and angle of contact with the forward face of the platform, results in projection at an upwards and outward angle. Attached at the end of the inner extension is the outer extension, also angling upward and outward, terminating with a cross-member which serves as the support for the forearm or barrel of the handgun. This results in sufficient upward rise and outward projection to accommodate a multitude of targeted handguns. Because of the angles, the weight of the handgun keeps the extensions in position. When not in use, the outer extension folds down, into, and flush with the inner extension, which in turn folds back onto the platform, which as intended, results in a package no larger than the platform itself when not in use.

The leg assembly includes a pair of mnovable legs. Preferably, they are coupled about an axle which engages a bracket movably mounted under the platform. Preferably the bracket engages a pivot about which the bracket may rotate, within constraints, relative to the platform. Thus the bracket mounting of the preferred embodiment allows the platform to rotate for target acquisition. Because the legs engage the axle within the bracket, the assembly is able to cant from side to side, allowing for adjustment to uneven ground. Preferably each leg telescopes or is otherwise able to be adjusted in length. The shooter can further rock the entire shooting rest back and forth to establish proper eye relief All movements are controlled with simple directional pressure from the shooter.

The preferred length of each leg of the bipod is appropriate to the prone shooting position. In use, the legs are opened forming a bipod at a pre-selected angle, thus forming the support under the platform. Further, by positioning the bipod under the platform, the center of gravity is disposed directly above the support where the majority of the handgun's weight and shooter support is required. As an added convenience, the legs may be configured and connected so that when not in use, both legs fold under and parallel with the platform.

The length-adjustable leg extensions allow the shooting rest to convert from use in the prone position to the sitting shooting position.

DETAILED DESCRIPTION

Referring now to the drawings, a handgun rest embodying the principles and concepts of the present invention is shown in FIGS. 1 to 12, the handgun rest indicated generally by the numeral 10 as described herein.

Figure 2:
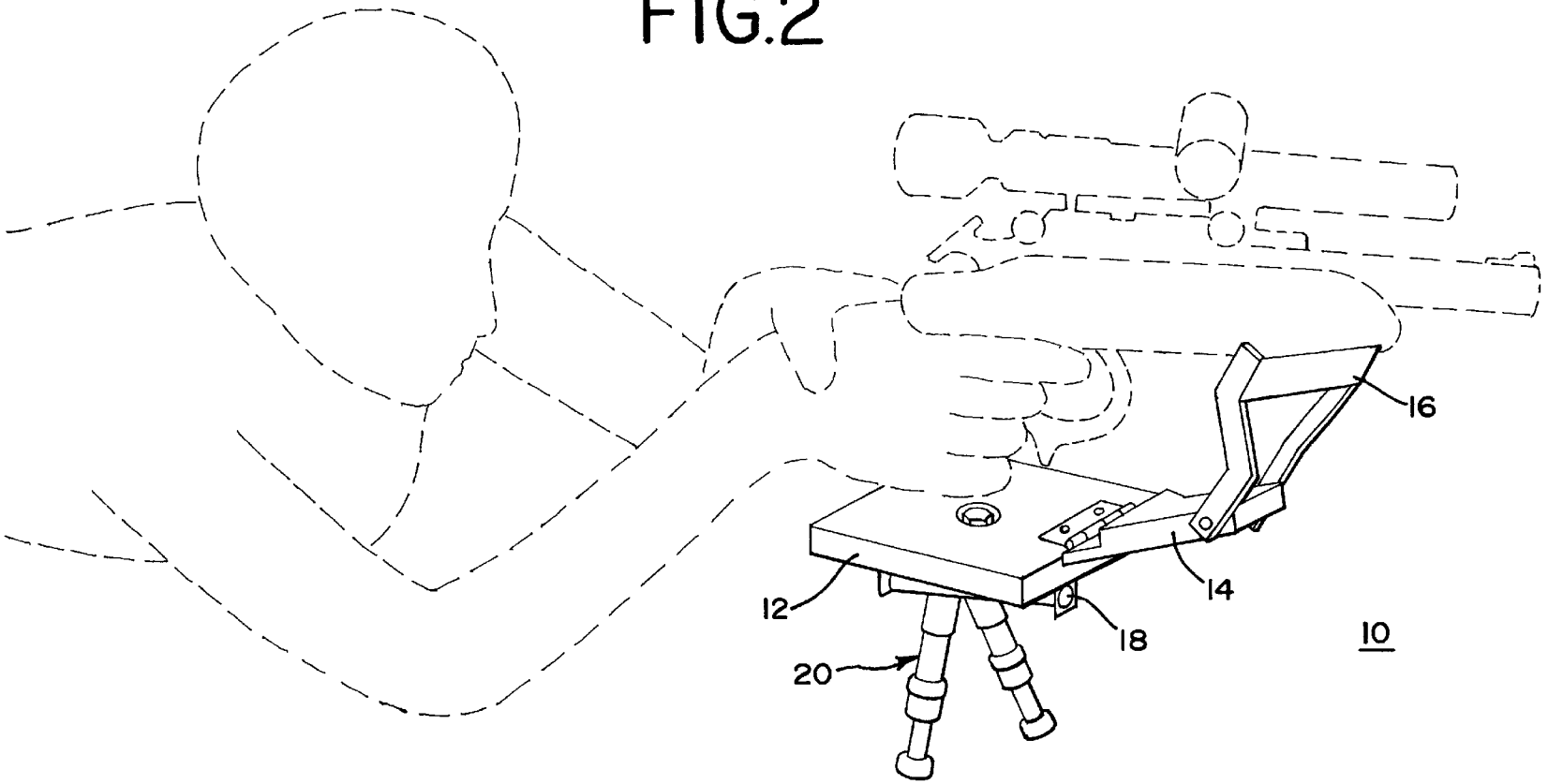
FIG. 2 is a perspective view, showing in phantom, a shooter utilizing the handgun rest of FIG. 1 but from the prone position with the leg extensions removed.

Turning first to FIGS. 1 and 2, a shooter is shown in phantom utilizing the handgun rest 10 in both sitting and prone shooting positions respectively. The sitting position, due to varying terrain, along with grasses and vegetation, has proven to be the more useful field position. Generally speaking, the major components of gun rest 10 comprise a shooting platform assembly 12, a first or "inner" extension 14 and a second or "outer" extension 16 extending from the inner extension 14. A bracket assembly 18 is secured under shooting platform assembly 12 so as to provide rotational movement to shooting platform assembly 12 (e.g. swiveling around a pivot member). A bipod leg assembly 20 is adjustably coupled to bracket assembly 18 so as to provide canting movement (e.g. rotation around an axle member that is perpendicular to the pivot member). FIGS. 1 and 2 show the major components and their relationship described herein. FIG. 1 additionally shows leg extensions 22 which can be utilized in the sitting, kneeling, or prone shooting positions. As will be appreciated by those skilled in the art, handgun rest 10 provides comprehensive support, making long range accuracy possible.

Figure 3:
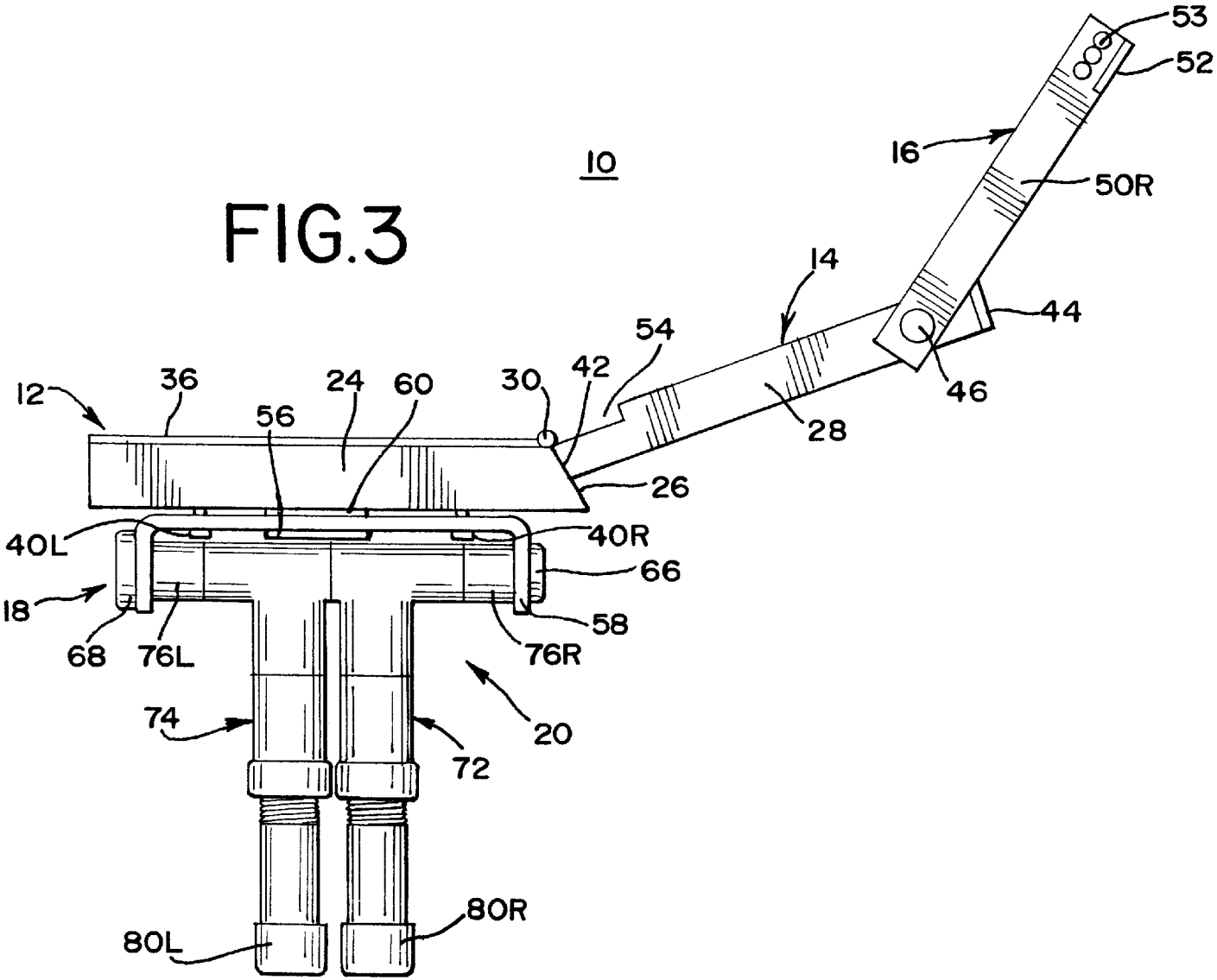
FIG. 3 is a perspective view of the handgun rest of FIG. 1 fully extended.

More specifically, as noted in FIG. 3, shooting platform assembly 12 includes a platform 24 on which the butt of the handgun grip, along with the shooter's hands, may be rested, thus providing rear support. Preferably, platform 24 is sized to a minimum dimension, still allowing for the largest hands. Illustratively, platform assembly 12 is generally square or rectangular, although other shapes can be used. Illustratively, the platform can have a nominal size of about 5 ½ inches long by about 4 to 4 ¼ inches wide. As an optional feature, the top of platform 24 may have fitted thereto or formed thereon a notch, groove, or other abutment (not shown) against which the pistol grip or base may be abutted in use for further stabilization At the forward side of platform 24 is an angled front face 26, the angle of which, as shown, is not vertical but instead preferably is less than ninety degrees from horizontal.

Figure 6:
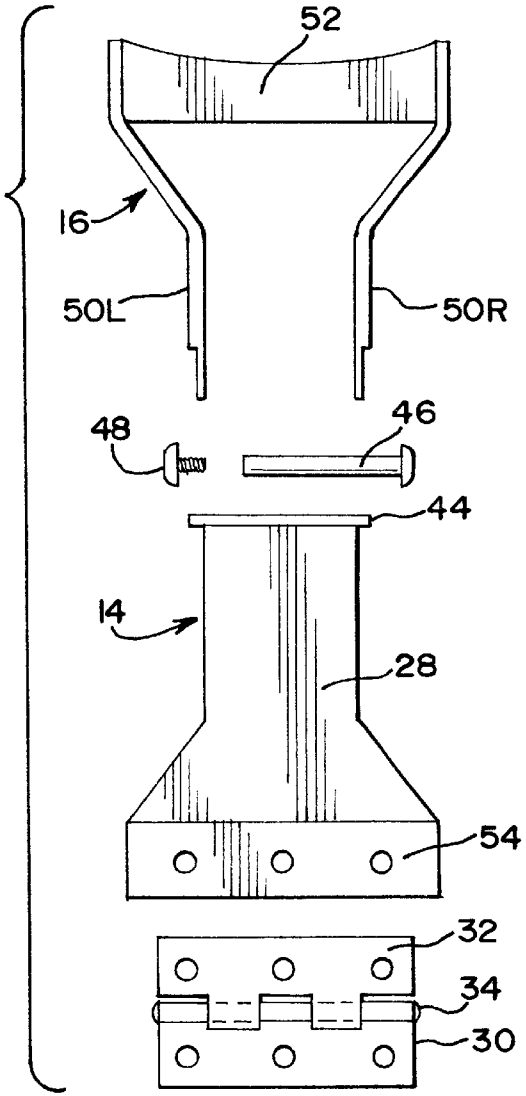
FIG. 6 is a plan view of both the inner and outer extensions, shown separated for component viewing purposes.
Figure 8:
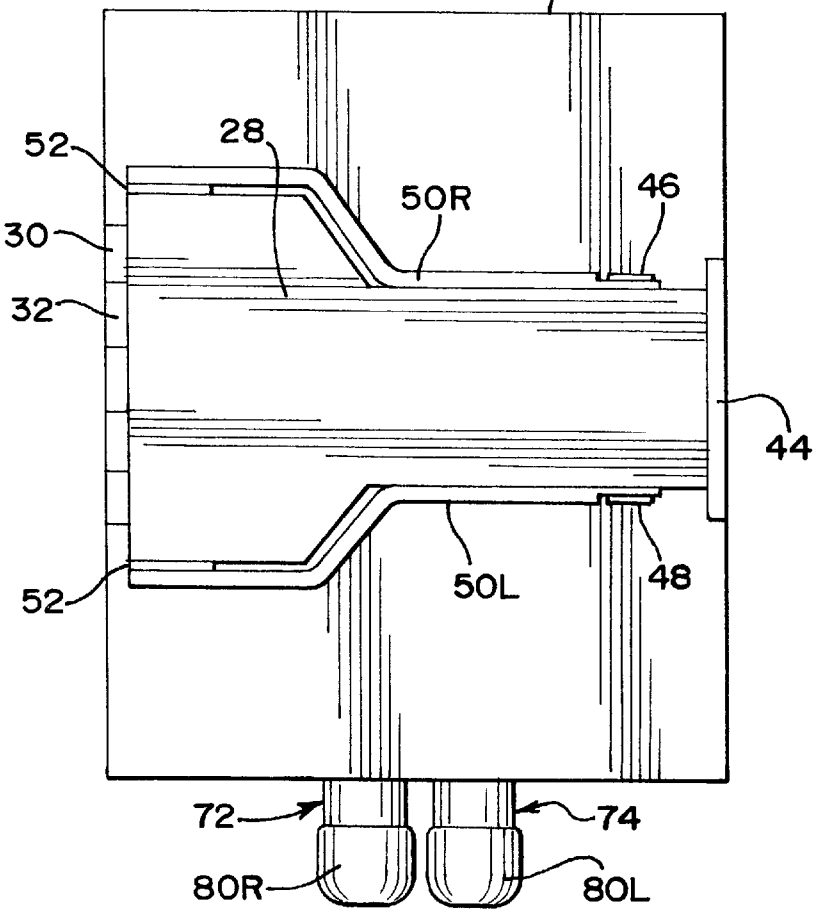
FIG. 8 is a plan view of the handgun rest of FIG. 1 with the inner and outer extensions in the folded position and with the two legs folded underneath the platform.

Inner extension 14, which may advantageously be seen in FIG. 6, includes an extension body 28 which preferably articulates with respect to the shooting platform assembly 12. Preferably, inner extension 14 is rotatably mounted on platform assembly 12 by means of a hinge or other articulating mechanism. The hinge permits inner extension 14 to articulate from a storage position (folded back upon the top of platform 24, as shown in FIG. 8) to a position for use, where it is supported by and rests on angled front face 26 so that inner extension 14 extends forward and upward, above the horizontal plane. FIG. 3 shows the edge of one portion 30 of the hinge.

An expanded view of the inner and outer extensions and the connections is shown in FIG. 6. The bottom of FIG. 6 shows a hinge having three elements 30, 32, 34. The hinge is to be connected at the front edge of platform 24. While shown in FIG. 6 as a conventional type hinge consisting of parts hinge-female 30, hinge-male 32, and hinge pin 34 for explanatory purposes only, in a preferred version the hinge or articulating mechanism would be integral with platform 24, that is, only the hole to receive hinge pin 34 would exist. Other types of hinges or other connecting devices for rotational coupling between inner extension 14 and platform 24 can be used.

Returning to FIG. 3, platform assembly 12 preferably further includes a neoprene cushion 36 or similar material applied to the top of platform 24 for cushioning and skid resistance.

Figure 5:
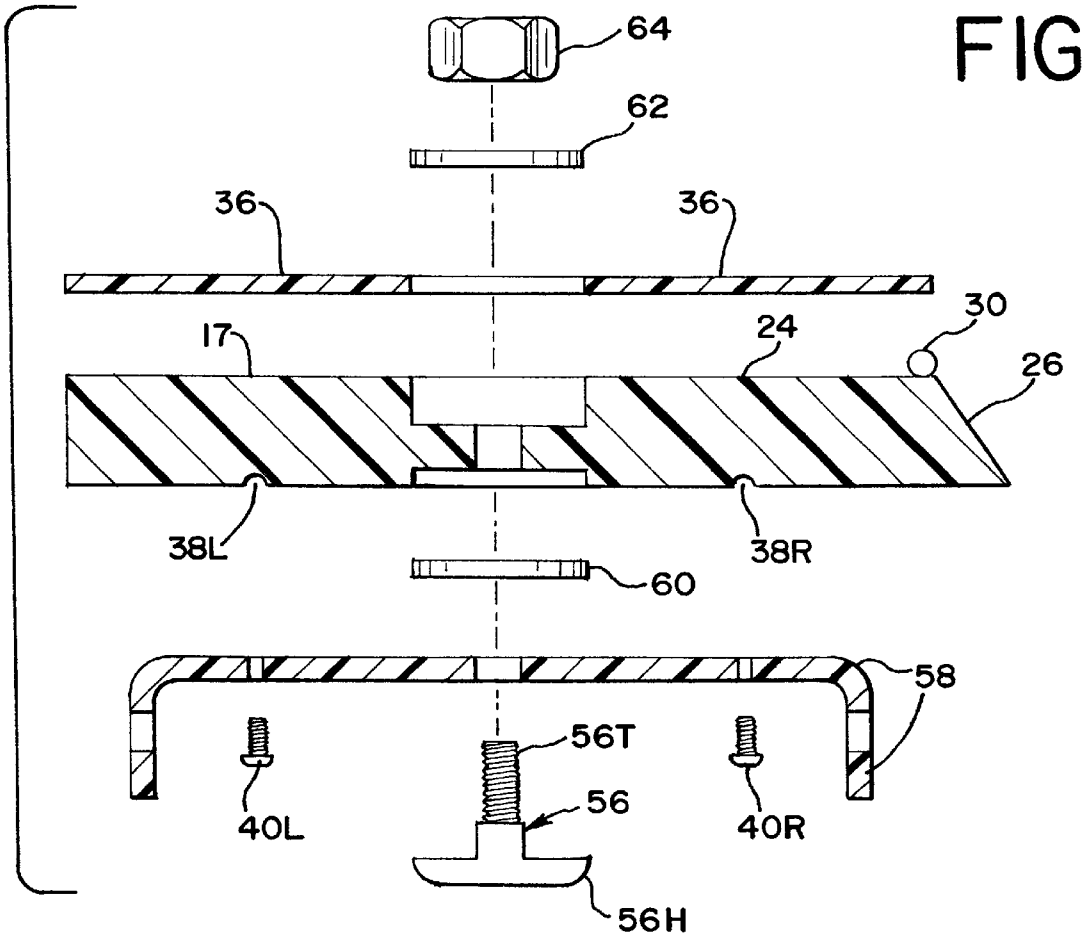
FIG. 5 is a cross-sectional view of the shooting platform, along with the bracket assembly which secures thereto.
Figure 9:
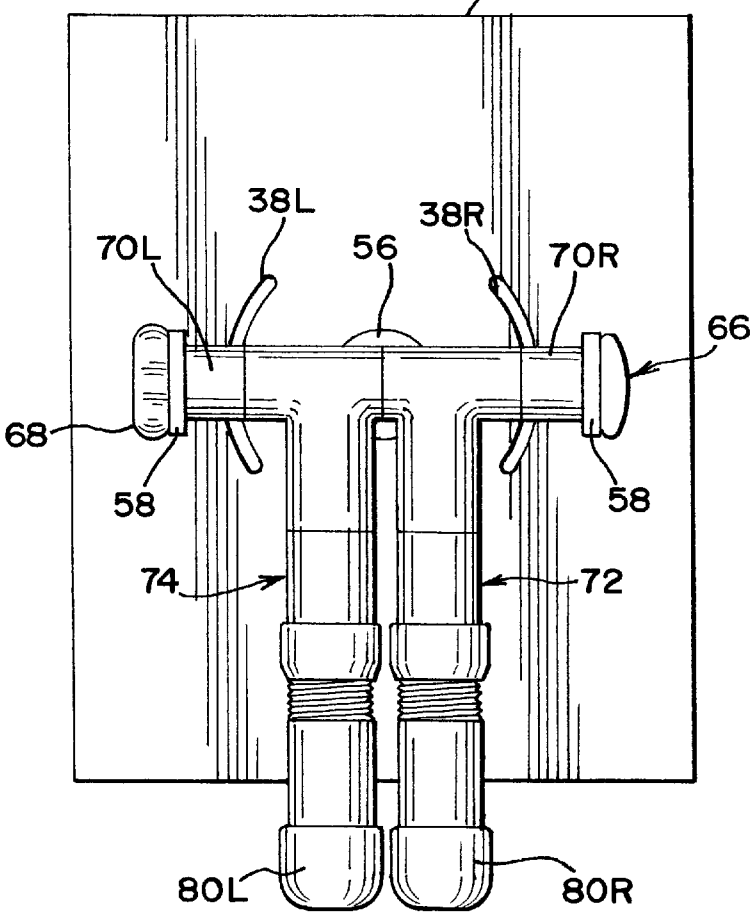
FIG. 9 is a bottom view of the handgun rest in the folded position, wherein the two legs are folded in the same direction under the shooting platform, parallel to one another. Also shown are two recess slots which serve to limit rotational travel, keeping the handgun rest oriented front and rear.

FIG. 3 also shows leg assembly 20 connected beneath platform 24. Illustrative details of a connection between the leg assembly and the platform are seen in FIGS. 5 and 9. FIG. 9 shows a bottom view of the platform with the leg assembly folded into a horizontal position, suitable for packing and transportation of the entire gunrest. The preferred connection is rotatable, i.e. allows rotation between the platform and the leg assembly. To that end, the bottom surface of platform 24 has a left recess slot 38L and right recess slot 38R. These engage a left rotation limit screw 40L (FIG. 5) and a right rotation limit screw 40R, both of which secure through bracket assembly 18, serving to limit the rotation of platform 24 and orient the entire assembly front and rear. Rotational movement thus results with simple directional pressure from the user. Further details of the rotational connection are given with respect to the discussion below of FIG. 5.

FIG. 3 further shows from a side elevation the relationship of inner extension 14 and outer extension 16 to shooting platform assembly 12. Specifically, an extension body 28 is joined to platform 24 by means of the hinge, one portion 32 of which is integral with extension body 28, by means of hinge pin 34 passing through both portion 32 and another portion 30. Extension body 28 includes an extension body interface 42, and when body 28 is rotated about pin 34 into the operative position, interface 42 comes into abutment with a platform interface 26. As noted above, extension 14 preferably does not rotate a full 180 degrees but instead comes to rest at an angle above the horizontal.

The inner extension includes an outer extension stop 44 at the forward end of extension body 28. The outer extension 16 assembly is rotatably coupled to extension body 28 illustratively by means of a screw post 46 and threaded screw 48, passing through, in sequence, a right side extension upright 50R, extension body 28, and a left extension upright 50L, as best seen in FIG. 6. At the free end of outer extension 16, a cross-member 52 is connected between the left and right extension uprights 50R and 50L. Cross member 52 cradles and provides the support for the handgun forearm or barrel, as applicable. As can be seen in FIG. 3, both inner extension 14 and outer extension 16 assemblies extend upwards and outwards, providing the predetermined amount of upwards rise and forward extension. As an alternate, stop pins could be used in lieu of outer extension stop 44. Other mechanisms can be used to limit the angle between the outer and inner extensions 14 and 16, respectively.

Figure 4:
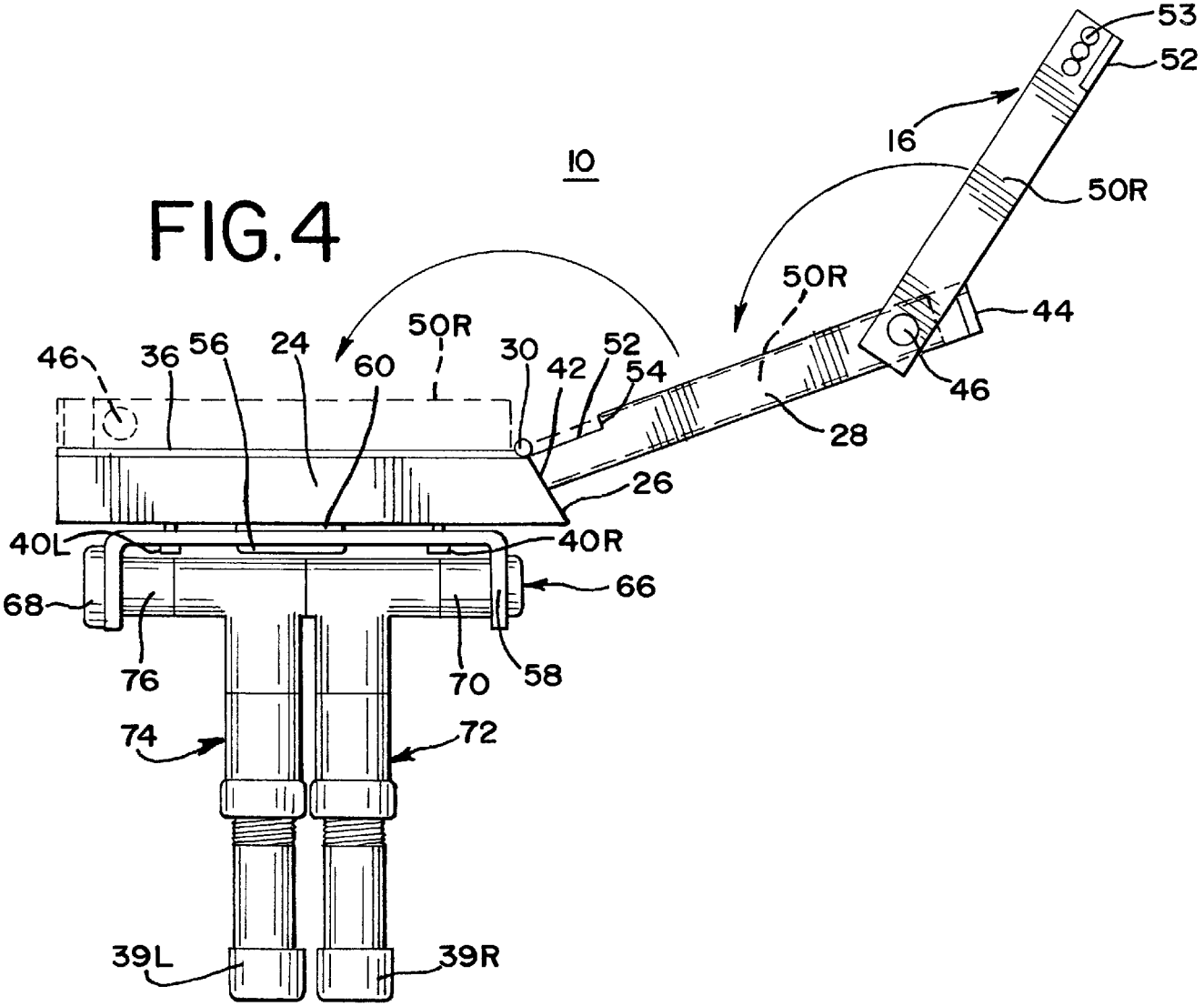
FIG. 4 is a perspective view of the handgun rest of FIG. 1 to illustrate, through the use of arrows, the outer extension folding onto the inner extension, which in turn folds back onto the shooting platform.

FIG. 4, through the use of directional arrows and phantom lines, shows outer extension 16 folding back onto inner extension 14, with cross-member 52 being received and fitting flush into a cross-member receiving slot 54, which in turn, because of the hinged arrangement between inner extension 14 and platform 24, folds back onto shooting platform assembly 12. This creates a compact and easily transportable package afield with a minimum of motion or effort. The parts comprising inner and outer extensions 14 and 16 are particularly detailed in FIG. 6. It will be appreciated that the present invention in some of its aspects can be practiced without the folding or compacting features. Thus, the movable elements described here can be made fixed, i.e. other structure can be used. The parts may be welded or formed integrally, or they could be separate parts that are fixedly joined by screws, pins, welds, rivets, or the like. Another embodiment can collapse in another fashion, such as, for example, by telescoping the outer extension onto or into the inner extension, with a suitable detent or other mechanism to hold the two extensions in the fully open position.

It may be noted that because the hinge members 30 and 32 are intended to be integral with platform 24 and extension body 28 respectively, the depth or thickness of extension body 28 directly under the cross-member receiving slot 54 can be increased from that shown. This dimensional increase at this specific point would serve three purposes. First, the size of the contact area at platform interface 26 and extension body interface 42 would be increased. Second, it would allow the cross-member receiving slot 54 depth to be increased, thereby allowing that cross-member 52 be increased in depth a like amount. Third, adjustment screws could be provided through the underside of extension body 28 angling through extension body interface 42, making contact with platform interface 26. Via these adjustment screws, small adjustments could now be accomplished, allowing for dimensional differences in handguns. In a further variation, cross-member 52 could be supplied either fixed or removable, and if removable, alternate cross-members 52 would be provided each with varying curvatures, providing yet further means of adjustment. Thus, a plurality of cross members can be supplied, each differing from the others, typically in height, thickness, or curvature. An additional variation that can be added is an adjustment for the position of cross member 52 relative to the outer extension uprights 50L, 50R. This can be achieved, illustratively, by forming a channel in the uprights with a detent or other fastener to engage cross member 52 at various predetermined positions relative to the uprights. Of course, more permanent fasteners in the form screws can be used to connect member 52 to the uprights, and plural screw holes (not illustrated) can be provided so that the user may select a pair of screw holes in which to mount the cross member 52 so that it best fits the gun to be used. Other mechanisms to provide linear selectable movement of cross member 52 relative to uprights 50L, 50R are within the scope of this invention. This is one height adjustment that can be used for adjusting the position at which cross member 52 engages or cradles the barrel or forearm of the weapon.

Bracket assembly 18 attaches underneath shooting platform assembly 12, the relationship of which is shown in FIGS. 3 and 4. Detailed in cross-sectional view in FIG. 5, along with shooting platform 12 assembly, including attachment thereto, a bracket 58 is rotatably coupled to platform 24 by any suitable attachment device, one example of which is a carriage bolt 56, 56H, and 56T. As detailed in FIG. 5 in order of sequence, a fastener such as a carriage bolt 56 passes through bracket 58, a bottom washer 60, platform 24, neoprene cushion 36, a top washer 62, and is secured with lock 10 nut 64. Lock nut 64 could be dimpled so as not to loosen once secured, yet is accessible from the top, allowing for tightening to suit the user, control rotational pressure, and allow for wear compensation. Bracket 58 is preferably thicker on the bottom than the two ends, as the ends must be able to give under the pressure from tightening, a thumbnut 68, the relationship of which is shown in FIGS. 3 and 4. Passing through bracket 58 is also a left rotation limit screw 40L and a right rotation limit screw 40R which engage left and right recess slots 38L, 38R respectively, limiting rotational travel and providing front and rear orientation as made clearer in FIGS. 9 and 11.

Figures 7, 7A:
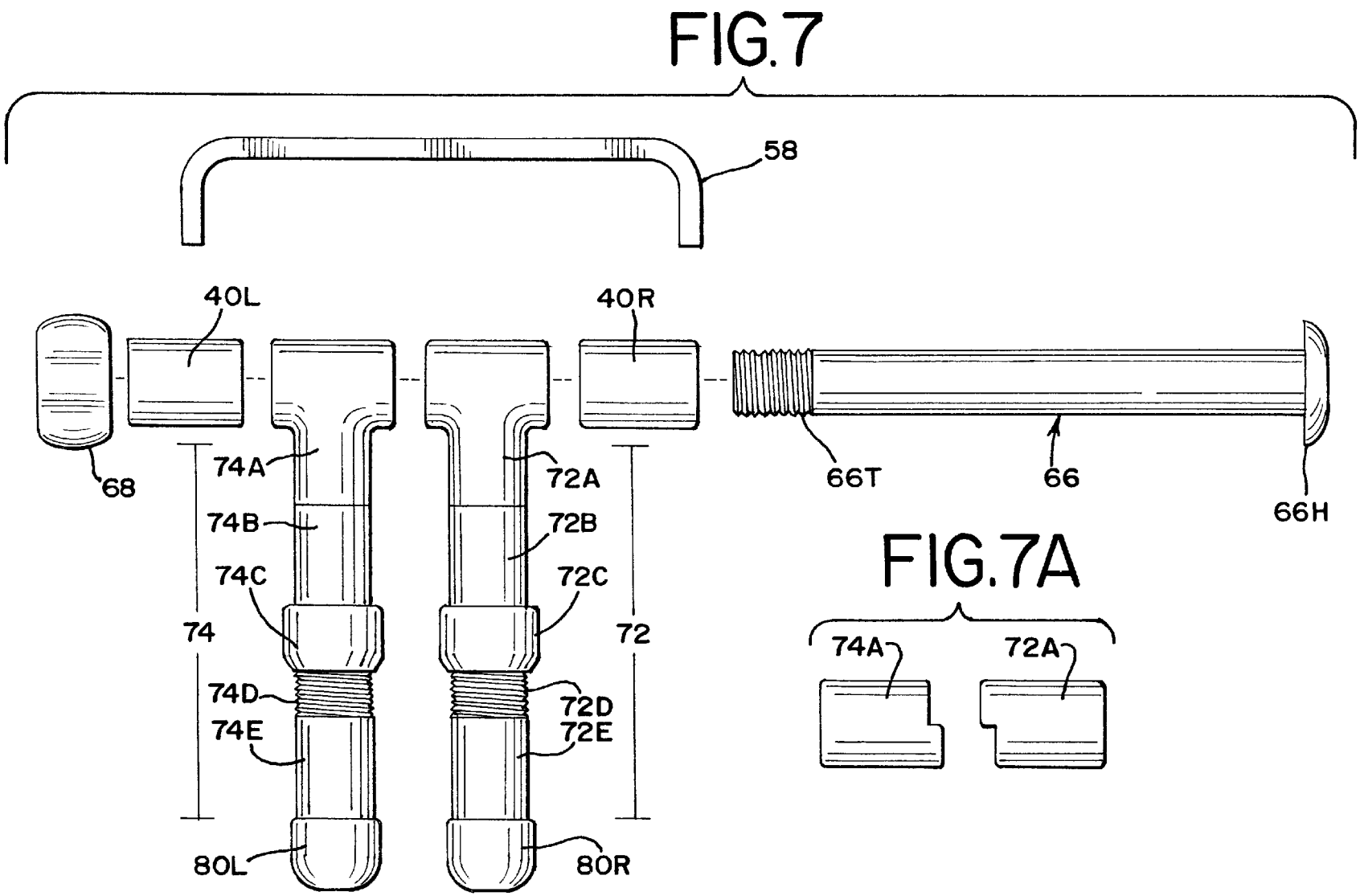
FIG. 7 is an expanded side view of the components forming the preferred leg assembly, which in turn are secured within the bracket attaching to the bottom of the shooting platform.
FIG. 7A is a top elevational view of the two legs, showing the interface between them and the preferred method of limiting the angular relationship of the legs.
Figure 10:
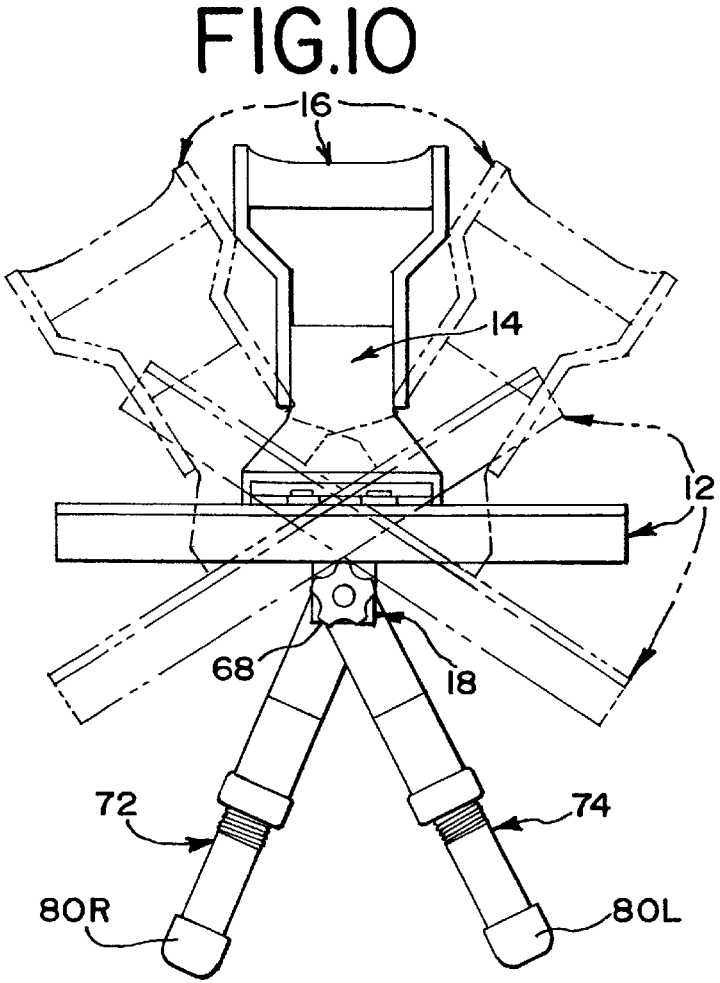
FIG. 10 is a rear perspective view showing canting movement of the shooting platform.

FIG. 7 shows some of the parts below the platform assembly 12 in an expanded view. The actual relationship is better depicted in FIGS. 3 and 4. In FIG. 7, the bipod leg assembly 20 comprises a horizontally oriented bracket carriage bolt 66, a right spacer 76R, a right leg 72, a left leg 74, a left spacer 76L, and thumbnut 68. More specifically, bracket carriage bolt 66 having a smooth shank, head section 66H, and threaded section 66T, passes through bracket 58 at one end. Sandwiched within bracket 58, bracket carriage bolt 66 passes through right spacer 76R, right leg 72, left leg 74, and left spacer 76L. Bracket carriage bolt 66 exits bracket 58 at the opposite end, where it is secured with thumbnut 68. This arrangement makes it possible for the bipod leg assembly 20 to rotate within bracket 58, providing a canting feature for handgun rest 10, as shown in FIG. 10. The amount of resistance to canting, when directional pressure is applied by the shooter, is determined by tensioning thumbnut 68 and the subsequent squeezing of bracket 58 on the bipod leg assembly 20. Left leg 74, while an integral unit, is comprised of a top section 74A, upper shank 74B, knurled or wrench flats section 74C, threaded section 74D, and lower shank 74E. The threaded section of the leg 74D is positioned so as not to come in contact with the ground when handgun rest 10 is used in the prone position. Leg is terminated with a cap 80L of the same diameter as the lower shank 74E. The companion leg 72 of the bipod has similar members 72A, B, C, D, and E, as well as a similar cap 80R.

FIG. 7A shows a view of leg top sections 72A and 74A, provides for an interface which limits the maximum spread of the bipod to a preselected angular relationship, nominally 25 degrees. Any angle less than the maximum can be utilized, resulting in height adjustment of shooting platform assembly 12 from ground level.

FIG. 8 shows a plan view of handgun rest 10 in the transport position. Both legs 72, 74 are folded parallel to one another underneath platform 24, and the two extension assemblies 14, 16 are folded back onto platform 24. Likewise, FIG. 9 is a bottom view of handgun rest 10 when in the transport position. It should be noted that the bipod leg assembly 20, as secured within bracket 58 tensioned with thumbnut 68, offers sufficient normal resistance to be held in this position during transport. This allows handgun rest 10, while in this position, to be carried by the user in a belt sheath by placing the folded legs within a pocket or loops, similar to that used for flashlights.

Figure 11:
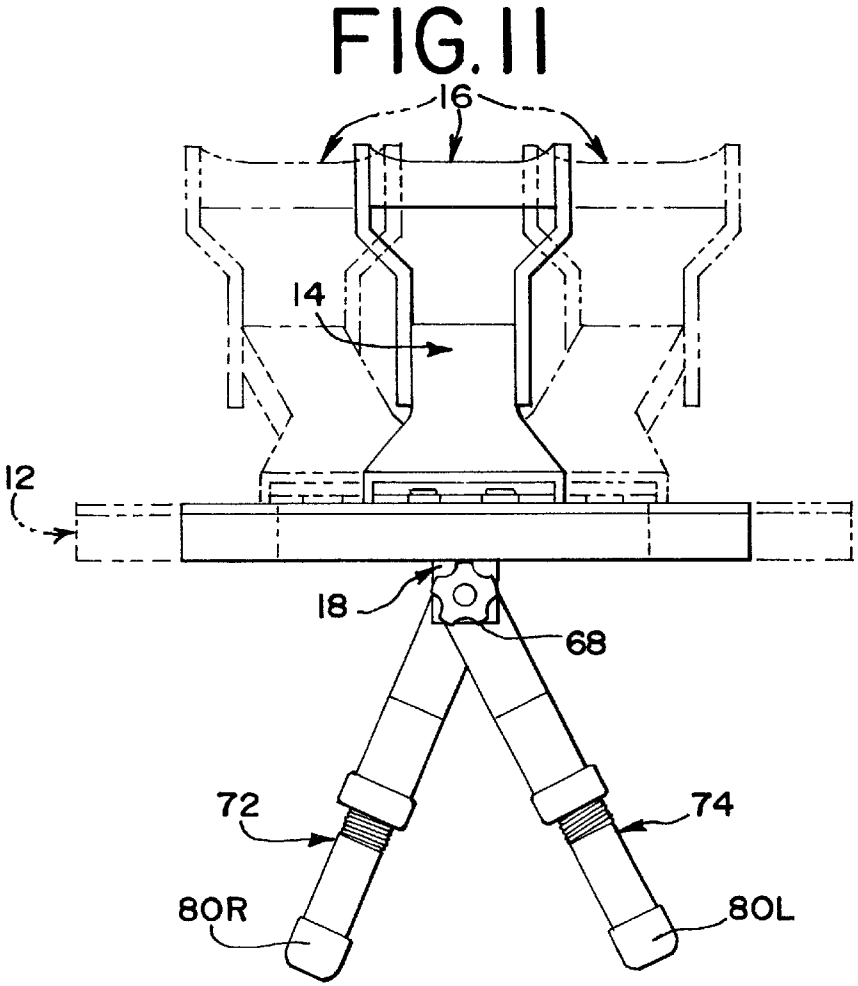
FIG. 11 is a rear perspective view showing rotational movement of the shooting platform.

FIGS. 10 and 11 illustrate both the canting and rotational feature respectively of the preferred embodiment handgun rest 10. The canting feature allows for adaptation to uneven ground, while the rotational feature allows for target acquisition and tracking. Both functions are controlled with directional pressure by the shooter.

Figure 12:
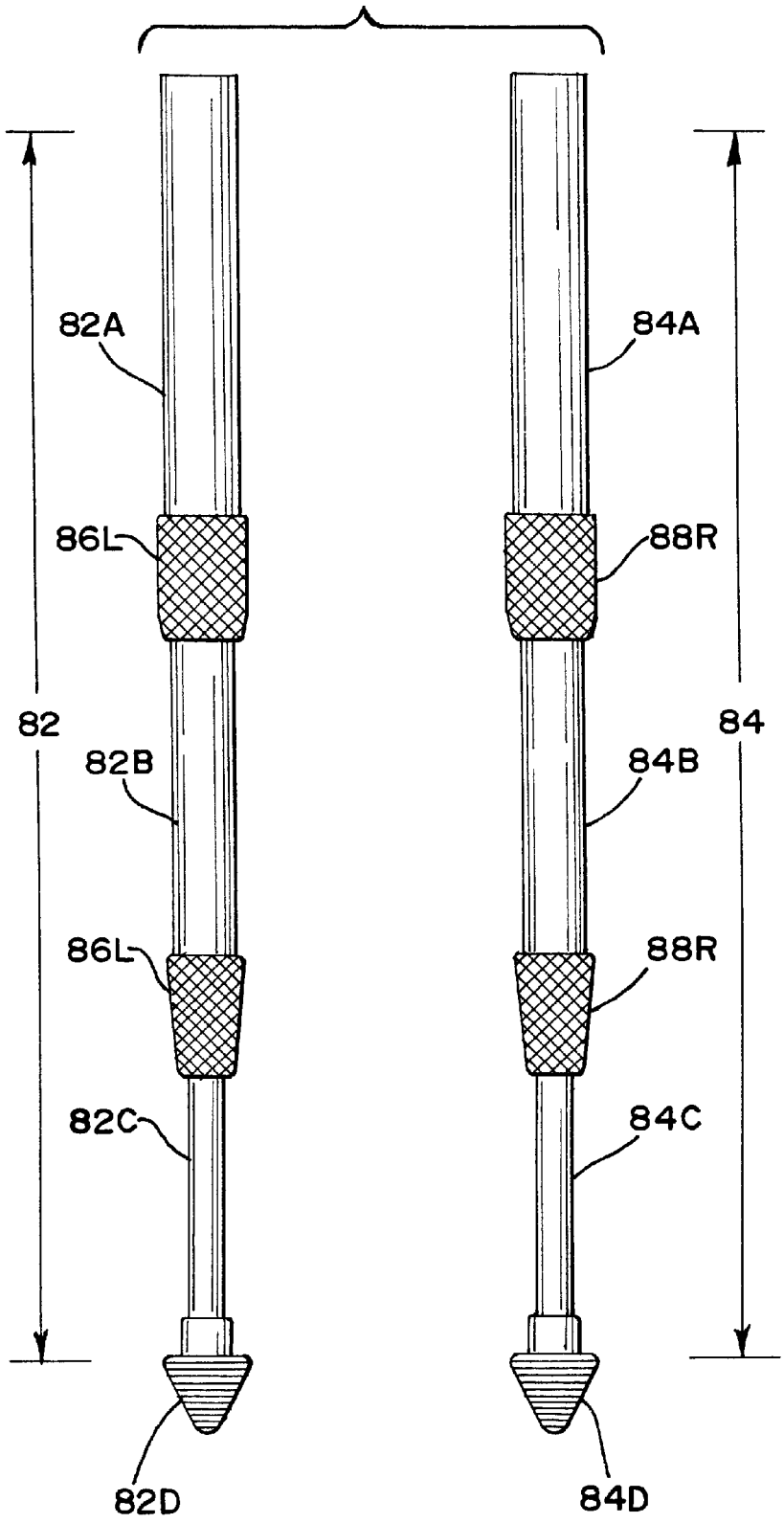
FIG. 12 is a side view showing two leg extensions which enable the handgun rest to be converted from prone position use to sitting position use.

FIG. 12 illustrates extensions for use of the handgun rest 10 in the sitting or kneeling positions. Left and right leg extensions 82 and 84 are shown. Extension 82 comprises, in sequence, a leg top sections 82A, left upper lock collar 86L, a leg mid section 82B, a lower lock collar 88L, and a lower leg section 82C. This extension 82 is terminated with a leg extension foot 82D. The end of leg top section 82A contains a female thread which engages male threads 74D on the bipod leg assembly 20, previously disclosed in FIG. 7. A corresponding right leg 84 is provided having corresponding members 84A, 86R, 84B, 88R, 84C, and 84D. Each leg descends as needed, and the sections are secured through compression supplied by each lock collar.

It should be noted that ideally bipod legs 72 and 74 shown in FIG. 7 would incorporate said extension feature, for conversion from prone to sitting positions, as part of their construction, thus eliminating the need for separate leg extensions 82 and 84. If in fact this range of adjustment can be provided within a single leg unit, while not affecting the integrity of representations made herein, the profile of bipod legs 72 and 74 would change accordingly.

Thus, the embodiment described with reference to FIGS. 1–12 permit rotation of the platform in one direction and in another direction perpendicular to the first direction, i.e. the platform rotates around a vertical pivot (formed by carriage bolt 56) and rotates or cants around a horizontal axle (formed by carriage bolt 66). In addition, this embodiment has an articulating extension assembly, preferably articulating about two horizontal axes provided by hinge pin 34 and pin or screw post 46.

A carry sheath into which the folded legs of the handgun rest will fit, secured with a strap or similar method, along with a pocket to contain the two extension legs, may also be provided to the user. This will be carried on the shooter's belt, lying flat against the outer upper thigh.

The manner of usage and operation of the illustrated embodiment is apparent from the above description and drawings attached thereto, as well as the obvious advantages to one skilled in the art. Preferred construction materials include high strength plastic, reinforced where required, metal alloy, and hardened steel at points subjected to wear through movement. Cross member 52 may be made of steel or a relatively hard plastic or elastic material, whether rubber or a synthetic material.

In the embodiment using all the aspects of FIGS. 1–2, when the legs have been folded under the platform and the gunrest 10 is in its most compact configuration (for travel or transportation), the user can simply and quickly rotate the two legs ninety degrees from the platform, open the two legs into a bipod of the desired angle, open the forward extension by two articulations or flips, and place the handgun on the platform with a forward portion of the gun, whether the barrel or forearm, cradled on the cross member. If extensible legs are used, the user can extend them at an appropriate time. However, because two degrees of rotation are already provided, even if the around is uneven, so that the platform is not horizontal when the bipod legs are spread and set upon the ground, the canting motion about the horizontally oriented axle member 66 permits the platform to be leveled. The swiveling around the pivot 56 permits target acquisition and tracking.

It will be appreciated that not all of the features set forth with reference to FIGS. 1–12 are needed to practice the present invention. For example, while it is preferred that the legs be able to fold under the platform, that is an added feature. While the extension has two articulations, that too is merely the preferred configuration: another configuration may have an extension with no articulations or with one articulation, or with a sliding mechanism wherein the extension slides forward from the platform from suitable guides or tracks or the like, and a vertical riser articulates upward therefrom or is in a fixed position relative to the sliding extension. The rotational aspects of the platform relative to the leg assembly can be achieved by other means than the pivot 56 and axle 66 described and illustrated herein. For example, a ball joint can be substituted to permit rotation in as many directions as desired. The ball joint can permit movement in one, two, or even three orthogonal directions. Such a ball joint can be connected between the platform (preferably the lower side thereof but not necessarily centrally) and the leg assembly. Further, it will be understood that the preferred embodiment uses bipod legs, as has been described. Of course, it is possible to use tripod legs also, along with other features of the present invention.

In another variation of the present invention, the platform may have two (or more) portions that form a generally flat surface when the gun rest is deployed in its shooting position, but which separate or articulate when the legs are brought together into the folded or transport position. Thus, the process of opening of the leg assembly would simultaneously raise or bring into position the two or more portions of the platform on which the shooter's hands will rest, through the use of connecting linkages into the legs and platform portions, raising and securing the platform portions into position.

It will be understood that the first and second extension members 14 and 16 engage or support the forearm or barrel of the handgun. As seen in FIG. 3, for example, the front contact point with the handgun is forward of the platform 24. Extension 14 is pivotally coupled to a peripheral edge of the platform, particularly the forward edge, illustratively via the hinge. When extension 14 is swung from its folded position into the support position, it unblocks the upper surface of platform 24, leaving a major area thereof available to support the butt of the gun and at least one of the shooter's hands, as seen in FIGS. 1 and 2. Being connected to the front of platform 24, it will be understood that first extension member 14 is non-centrally coupled thereto. As plainly seen, when in the support position, member 14 is not connected in nor does it occupy the middle of the platform 24.

Inasmuch as the present invention is subject to modification and variations may be made without departing from the concept or scope of the invention described herein, along with equivalents which may be resorted to, it is intended that the description of the present embodiment be representative and not restrictive.

I claim:

1. A compact handgun rest suitable for use while afield, comprising:

a platform having a predetermined size that is commensurate in size with the hands of a shooter holding the handgun; and an extension movably connected to said platform at a non-central position of said platform, said extension being movable between a closed position and a support position;

wherein said extension in said support position extends forward and upward from said platform to support a forward portion of the handgun, wherein in said support position; said extension is positioned to leave space on the platform for the shooter to rest at least one hand on said platform supporting the handgun, and the platform is sufficiently unobstructed for the shooter to rest said at least one hand thereon, whereby the handgun is supported at fore and aft positions.:

2. The handgun rest of claim 1 wherein said extension in said support position supports a forward portion of the handgun at a contact point that is forward of a front edge of said platform.

3. The handgun rest of claim 1 wherein said platform has front, rear, and side edges, and wherein said extension is connected to said platform along said front edge.

4. The handgun rest of claim 3, wherein said extension includes an interface portion for selective contact with a corresponding portion of said platform when said extension is in said support position, thereby limiting movement between said platform and said extension.

5. The handgun rest of claim 3 further including a hinge movably coupling said extension to said front edge of said platform.

6. The handgun rest of claim 1:

said extension comprising an extension assembly having first and second extension members, said first extension member being movably connected to said platform, said second extension member being movably connected to said first extension member and not connected directly to said platform, said second extension member including a free end at one extremity;

said extension assembly in said support position extending forward and upward so that said free end of said second member supports the forward portion of the handgun at a position that is forward and upward from said front edge of the platform.

7. The handgun rest of claim 6, wherein said extension assembly further comprises a pivot mechanism engaging said first and second extension members to permit rotational movement therebetween.

8. The handgun rest of claim 6 wherein said second extension member includes a cross member constituting said free end.

9. The handgun rest of claim 8 wherein the position of said cross member is adjustable longitudinally along said second extension member.

10. The handgun rest of claim 6 wherein said first and second extension members are configured to be nestled together when the rest is in a partially folded position, and said nestled-together extension members are rotatable onto said platform in a fully folded position.

11. The handgun rest of claim 6 wherein said first extension member is rotatably connected to said second extension member and wherein said second extension member is received by said fast extension member, and wherein both said first and said second extension members are rotatably received onto said platform in a fully folded and compact configuration.

12. The handgun rest of claim 1 wherein said platform has a length that is about the same as a length of said extension.

13. The handgun rest of claim 1 wherein said platform is about 5 ½ inches long.

14. The handgun rest of claim 1 wherein said platform is about 4 to 4 ¼ inches wide.

15. A handgun rest according to claim 1 wherein said extension comprises:

an extension assembly having first and second extension members, said first extension member being movably connected to said platform, said second extension member being movably connected to said first extension member and not connected directly to said platform, said extension assembly in said support position extending forward and upward so that a free end of said second extension member supports a forward portion of the handgun at a position forward of and upward from a front edge of the platform.

16. The handgun rest of claim 15 wherein said first extension member includes an interface portion for selective contact with a corresponding portion of said platform when said extension assembly is in said support position, thereby limiting movement between said platform and said extension.

17. The handgun rest of claim 15 including a hinge movably coupling said first extension member to said platform.

18. A compact handgun rest for use by a shooter while afield comprising:

a platform having a predetermined size that is commensurate with the size of the hands of a shooter holding the handgun; and an extension movably connected to a front edge of said platform, wherein said extension is movable into a support position which extends forward and upward from said platform to support a forward portion of the handgun forward of the front edge of said platform, said platform being substantially empty when said extension is in said support position for supporting at least one hand of the handgun shooter, holding the handgun, upon said platform, whereby said handgun is supported at fore and aft positions.

19. The handgun rest of claim 18 further including a hinge movably coupling said extension to said front edge of said platform said hinge permitting said extension to) rotate from a closed position, in which the extension is substantially wholly located upon of said platform, through an angle greater than 90 degrees to said support position.

20. The handgun rest of claim 19 wherein said extension comprises an extension assembly having first and second extension members, said first extension member being rotatably connected to said second member, said second extension member not being directly connected to said platform.

21. The handgun rest of claim 20 wherein said extension assembly further comprises a pivot mechanism engaging said first and second extension members to permit rotational movement therebetween from an angle of about zero degrees to an angle greater than 90 degrees.

22. The handgun rest of claim 21 wherein said extension assembly further includes a cross member at a free end of said second extension member.

23. The handgun rest of claim 22 wherein the position of said cross member is adjustable longitudinally along said second extension member.

24. The handgun rest of claim 21 wherein said first and second extension members are configured to be nestled together when the rest is in a partially folded position, and said nestled-together extension members are rotatable onto said platform in a fully folded position.

25. The handgun rest of claim 21 wherein one end of said first extension member is pivotally connected at the front edge said platform and said pivot mechanism is located at an opposite end of said first extension member.

26. The handgun rest of claim 18 further comprising a leg assembly coupled to said platform, wherein said leg assembly is configured to permit canting in side-to-side and front-to-back directions.

27. The handgun rest of claim 18 wherein said platform has a length that is about the same as a length of said extension..

28. The handgun rest of claim 18 wherein said platform is about 5½ inches long.

29. The handgun rest of claim 18 wherein said platform is about 4 to 4¼ inches wide.

30. A handgun rest comprising:

a platform to support at least one hand of a shooter holding the handgun on a substantially flat surface of the platform;

a first extension member having a first end and a second end opposite to said first end;

a first rotational coupling device coupling located at a front portion of said platform and corrected to said first end of the first extension member to permit rotational movement of the first extension member relative to said platform;

a second extension member having a first end and a second end opposite to its first end;

a second rotational coupling device connected between the second end of the first extension member and said first end of said second extension member to permit rotational movement of the second extension member relative to the first extension member;

said second extension member not being coupled to said platform except via said rotational couplings and said first extension member;

said extension members being rotatable between a folded position and an folded position in sequential first and second rotating steps, wherein in said folded position the first and second extension members are folded onto said platform, and wherein in said unfolded position said extension members are not located upon or over the platform;

wherein in said unfolded position a free end of said second extension member supports a fore end of the handgun and said platform supports at least one hand of the shooter and the butt of the handgun.

31. The handgun rest of claim 30 wherein said platform has a back edge and a front edge with a first length therebetween;

wherein said first extension member has a length approximately equal to said first length so that when said first extension member is rotated onto said platform, the said second end of the first extension member is approximately aligned with the back edge of the platform;

wherein said second extension member has a length less than or equal to the length of said first extension member.

32. The handgun rest of claim 30 wherein said platform has a length that is about the same as a length of said extension.

33. The handgun rest of claim 30 wherein said platform is about 5½ inches long.

34. The handgun rest of claim 30 wherein said platform is about 4 to 4¼ inches wide.

35. A method of operating a handgun rest comprising the steps of:

providing a platform sized to support at least one band of a shooter of the handgun on a substantially flat surface of the platform;

providing first and second extension members, said first extension member being rotatably coupled to said platform at a first end of the first extension member and being rotatably coupled to said second extension member at a second end of the first extension member opposite to said first end;

rotating said extension members from a folded position to an unfolded, support position in sequential first and second rotating steps, wherein in said support position said extension members are not located upon or over the platform;

said first rotating step comprising rotating said first extension member, together with said second extension member while it is folded onto said first extension member, about a first axis of rotation located substantially at the front of said platform so that said first and second extension members rotate together away from the front of said platform to a partially folded-partially unfolded position;

then, in a second rotating step, rotating said second extension member thereby to rotate a free end thereof into a support position for supporting a forward portion of the handgun at said free end forward and upward from the front edge of the platform.

36. The method of supporting a handgun of claim 35 wherein said platform has a back portion and a front end;

wherein said first extension member first end is associated with a first axis of rotation used in said first rotating step and said second end is associated with a second axis of rotation used in said second rotating step;

wherein said second extension member has a first end associated with said second axis of rotation, and wherein said free end is opposite to said second extension member first end;

wherein in said folded position, said free end of said second extension member and said first end of said first extension member are located over said front of said platform, and wherein said first end of said second extension member and said second end of said first extension member are located over a back portion of said platform.

37. The method of claim 35 wherein at least one of said rotating steps comprises rotating through an angle greater than 90 degrees.

38. The method of claim 35 wherein both said first and said second rotating steps comprise rotating through respective angles greater than 90 degrees.

39. The method of supporting a handgun of claim 35 further comprising canting the platform with respect to a leg assembly associated with said platform thereby to level the position of the platform notwithstanding local unevenness of an underlying terrain where the handgun rest is being used.

40. The method of claim 35 wherein the method includes rotating said extension members from said unfolded, support position to sand folded position in sequential third and fourth rotating steps, wherein said third rotating step includes rotating the second extension member onto said first extension member, wherein said fourth rotating step is performed after said third rotating step and includes rotating the first extension member, with the second extension member already rotated onto it, onto said platform.

* * * * *